US007740237B2

(12) United States Patent
Mano

(10) Patent No.: US 7,740,237 B2
(45) Date of Patent: Jun. 22, 2010

(54) SHEET POST-PROCESSING APPARATUS

(75) Inventor: Shinichiro Mano, Hadano (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 528 days.

(21) Appl. No.: 11/615,333

(22) Filed: Dec. 22, 2006

(65) Prior Publication Data

US 2008/0150209 A1 Jun. 26, 2008

(51) Int. Cl.
*B65H 37/04* (2006.01)

(52) U.S. Cl. ..... 270/37; 270/32; 270/58.07; 270/58.08; 270/58.11; 270/58.12; 270/58.17

(58) Field of Classification Search ..... 270/20.1, 270/32, 37, 58.07, 58.08, 58.12, 58.17
See application file for complete search history.

(56) References Cited

U.S. PATENT DOCUMENTS 3,371,926 A * 3/1968 Anderson et al. ..... 271/298
5,026,036 A * 6/1991 Takahashi ..... 271/3.03
5,229,812 A * 7/1993 Toyama et al. ..... 355/50
5,263,697 A * 11/1993 Yamazaki et al. ..... 270/58.08
6,427,997 B1 * 8/2002 Hirota et al. ..... 270/58.12
2004/0046304 A1 * 3/2004 Itou et al. ..... 270/32

FOREIGN PATENT DOCUMENTS

JP 2000-86056 3/2000
JP 2001-287846 10/2001
JP 2002-356269 12/2002
JP 2002356269 A * 12/2002
JP 2005-022175 1/2005

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A post-processing apparatus that is set beside an image forming apparatus and applies staple processing to sheets subjected to image formation and folds the sheets to manufacture a booklet includes a hooking control mechanism that is provided on the opposite side of center folding rollers across a sheet bundle and pushes the sheet bundle in a stapler direction to prevent a bent staple from hooking on an edge of an anvil.

14 Claims, 7 Drawing Sheets

SHEET POST-PROCESSING APPARATUS

BACKGROUND OF THE INVENTION

1. Field of the Related Art

The present invention relates to a sheet post-processing apparatus that performs staple processing, the sheet post-processing apparatus including a hooking control mechanism that prevents a staple from hooking on an edge of an anvil.

2. Description of the Related Art

A post-processing apparatus that is set beside an image forming apparatus, applies staple processing to sheets subjected to image formation, and folds the sheets to manufacture a booklet has been developed (e.g., JP-A-2005-22175).

This post-processing apparatus ties up sheets subjected to image formation in a sheet bundle including a predetermined number of sheets, aligns the sheets to staple the sheet bundle in the center of the sheets, and folds the sheet bundle by letting the sheet bundle to pass between a pair of center folding rollers to manufacture a booklet.

In the conventional sheet post-processing apparatus, there is a problem in that, in conveying the sheet bundle to the center folding rollers after the staple processing, a staple hooks on an edge of an anvil to prevent smooth conveyance. There is also a problem in that the sheets are scratched because the sheets are conveyed in contact with the edge of the anvil.

BRIEF SUMMARY OF THE INVENTION

It is an object of the present invention to provide a sheet post-processing apparatus including a hooking control mechanism that prevents a staple of sheets subjected to staple processing from hooking on an edge of an anvil.

In an aspect of the present invention, the sheet post-processing apparatus includes: a stapling device having a stapler that strikes out a staple to a sheet bundle and an anvil that bends the staple; center folding rollers that fold the sheet bundle subjected to staple processing in the center thereof; and a hooking control mechanism that is located on the opposite side of the center folding rollers across the sheet bundle and pushes the sheet bundle in a direction of the stapler to prevent the bent staple from hooking on an edge of the anvil.

DETAILED DESCRIPTION OF THE EMBODIMENT

Figure 1:
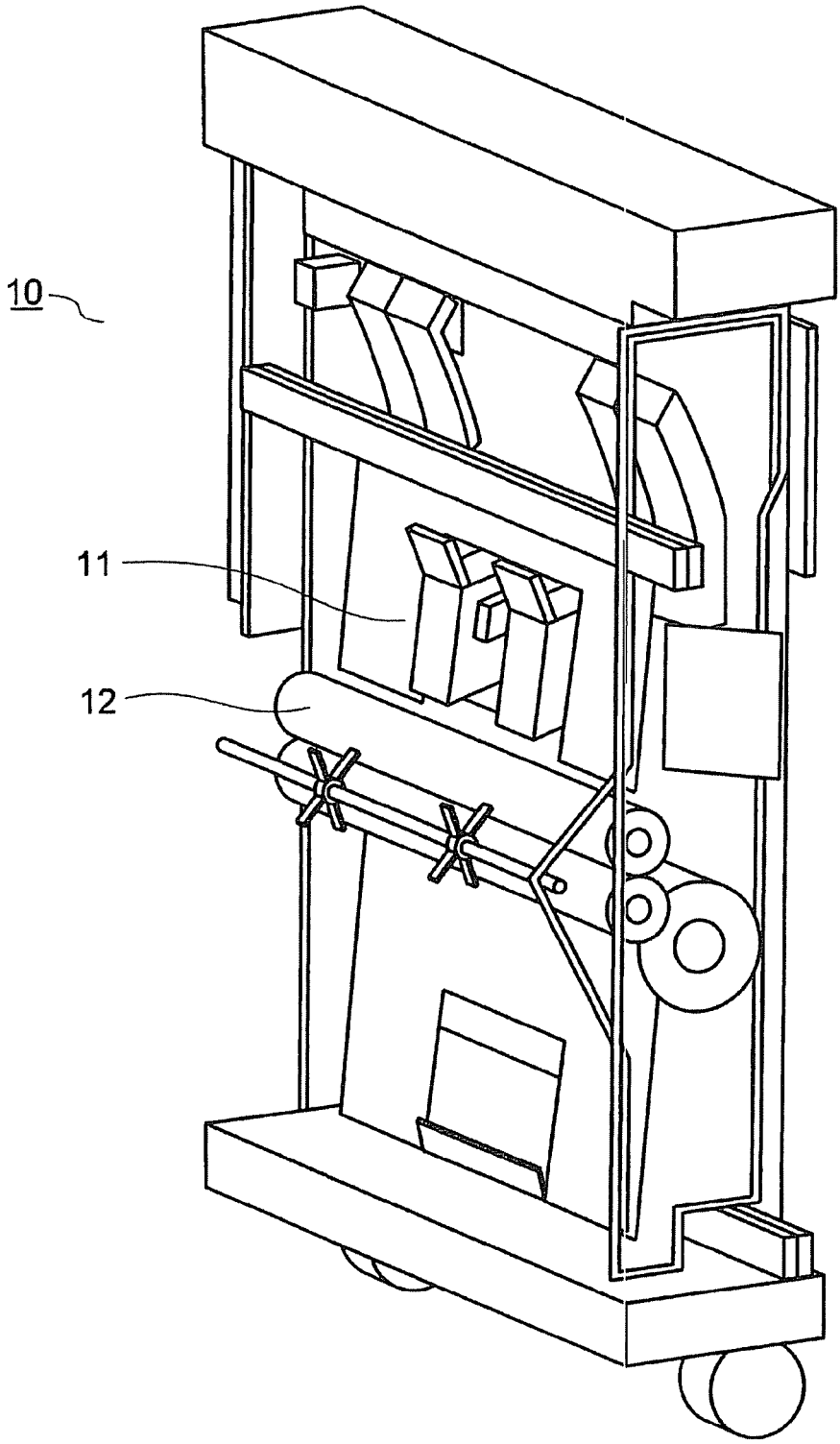
FIG. 1 is a perspective view showing a main part of a sheet post-processing apparatus.

Throughout this description, the embodiments and examples shown should be considered as exemplars, rather than limitations on the apparatus and methods of the present invention.

An embodiment of the present invention will be hereinafter explained with reference to the drawings. In the respective figures, identical components are denoted by identical reference numerals and redundant explanations of the components are omitted.

FIG. 1 is a perspective view showing a main part of a sheet post-processing apparatus 10 according to an embodiment of the present invention. The sheet post-processing apparatus 10 includes a stapling device 11 that receives sheets from an image forming apparatus and staples the sheets to form a sheet bundle in which a predetermined number of sheets are aligned and a pair of center folding rollers 12 that are provided on the opposite side of the stapling device 11 across the sheet bundle and fold the sheet bundle in the center thereof.

Besides, the sheet post-processing apparatus 10 may include a waiting tray that receives sheets from the image forming apparatus and puts the sheets on standby for post processing, a processing tray that is arranged below the waiting tray and receives the sheets supplied from the waiting tray, and a sheet discharge tray that is stacked with the sheets discharged after the post processing and may have post-processing functions other than a booklet manufacturing function such as sort processing, punching processing, and staple processing at a sheet end and various devices for the post processing functions.

Figure 2:
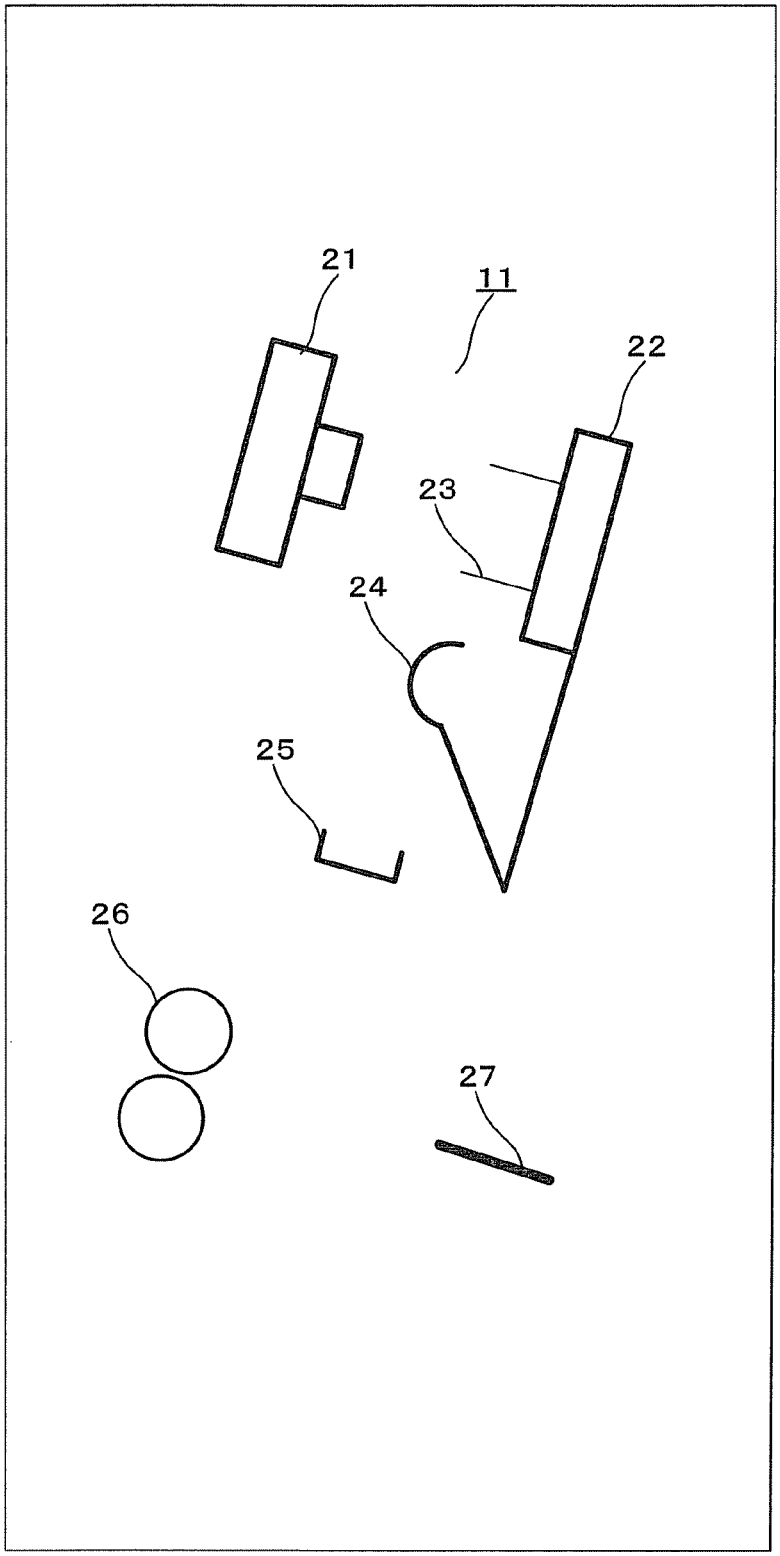
FIG. 2 is a diagram of the sheet post-processing apparatus viewed from a side thereof.

FIG. 2 is a diagram of a section near the stapling device disposed in the sheet post-processing apparatus according to this embodiment viewed from a side thereof. In the sheet post-processing apparatus, the stapling device 11 having a stapler 21 that strikes a staple into a sheet bundle and an anvil 22 that bends a staple extruded, a sheet aligning member 25 that aligns the sheet bundle and conveys the sheet bundle subjected to staple processing, a folding mechanism having a pair of center folding rollers 26 and a blade 27 that fold the sheet bundle subjected to the staple processing in the center thereof, and a hooking control mechanism 24 that is provided on the opposite side of the center folding rollers 26 across the sheet bundle and pushes up the sheet bundle in a direction of the stapler 21 to prevent the bent staple from hooking on an edge 23 of an anvil are disposed.

Figure 3:
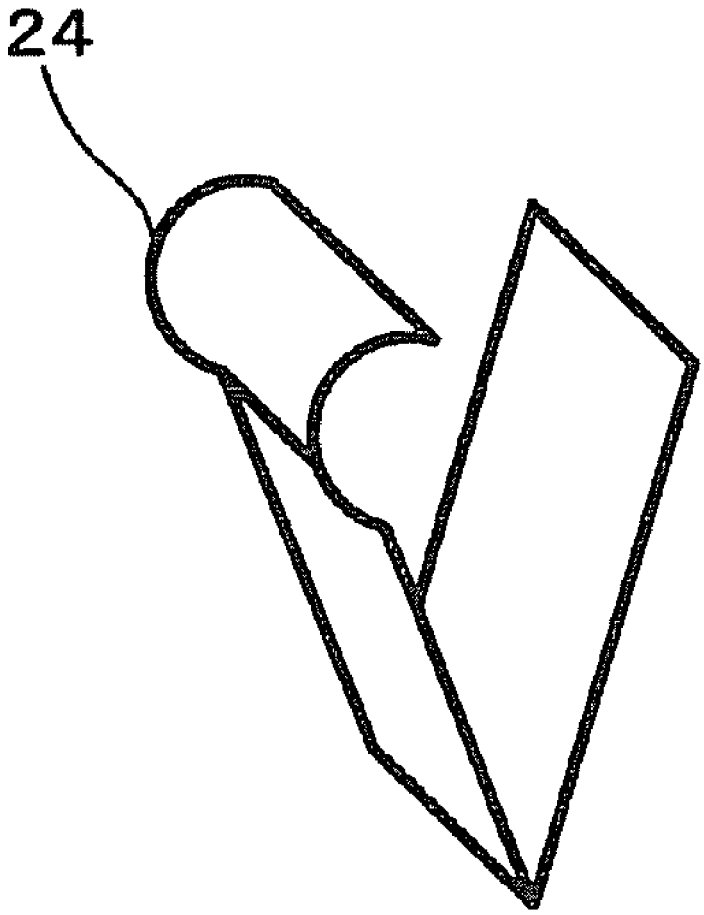
FIG. 3 is a perspective view of a hooking control mechanism.

FIG. 3 is a perspective view of the hooking control mechanism 24. The hooking control mechanism 24 is formed in, for example, a leaf spring shape and has a curved surface in a portion thereof coming into contact with the sheet bundle. This curved surface is a surface for reducing a frictional force against a sheet surface when the sheet bundle is conveyed. In FIG. 3, the portion coming into contact with the sheet bundle is formed in a substantially semi-cylindrical shape.

Figure 4:
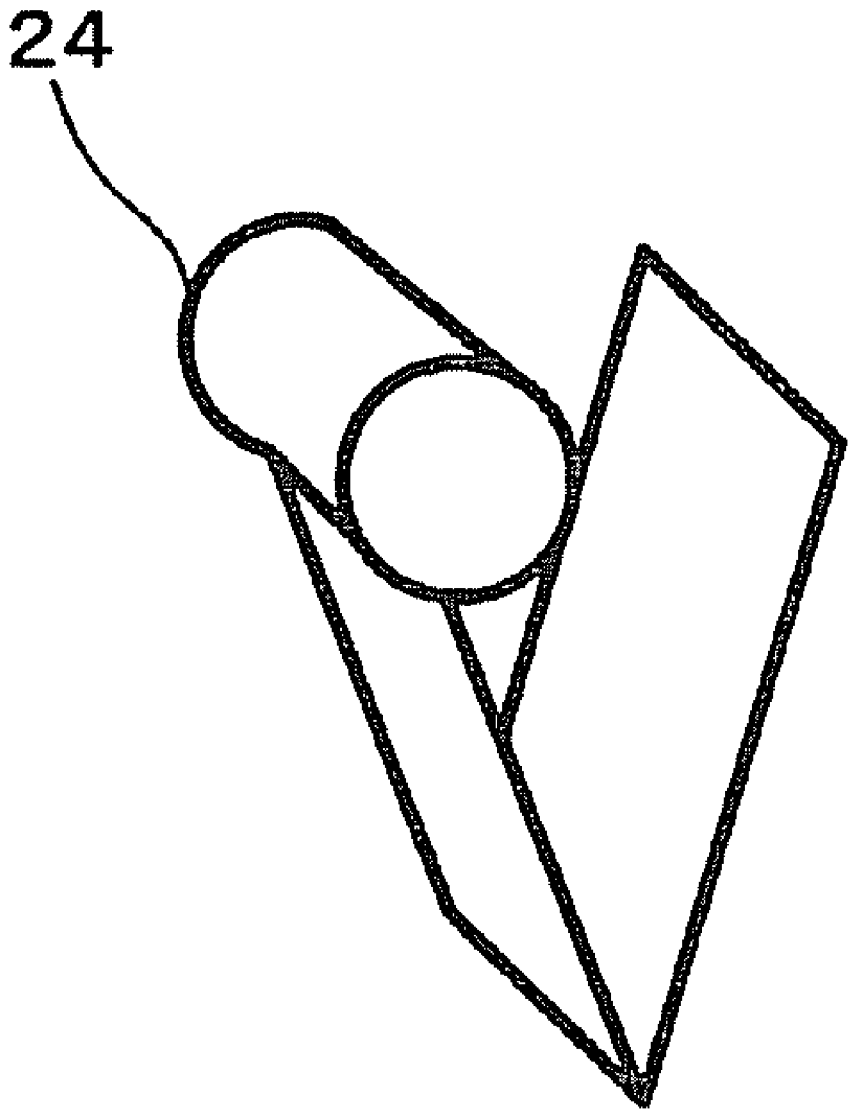
FIG. 4 is a perspective view of another example of the hooking control mechanism.

FIG. 4 is a perspective view of another example of the hooking control mechanism 24. In FIG. 4, the portion of the hooking control mechanism 24 coming into contact with the sheet bundle is formed in a columnar shape. The portion coming into contact with the sheet bundle may be formed in a spherical shape.

A compression spring may be used instead of the leaf spring. When the compression spring is used, it is possible to constitute the hooking control mechanism 24 by removing, for example, the leaf spring portion of the hooking control mechanism and locking the portion coming into contact with the sheet bundle to the end of the compression spring.

Figure 5:
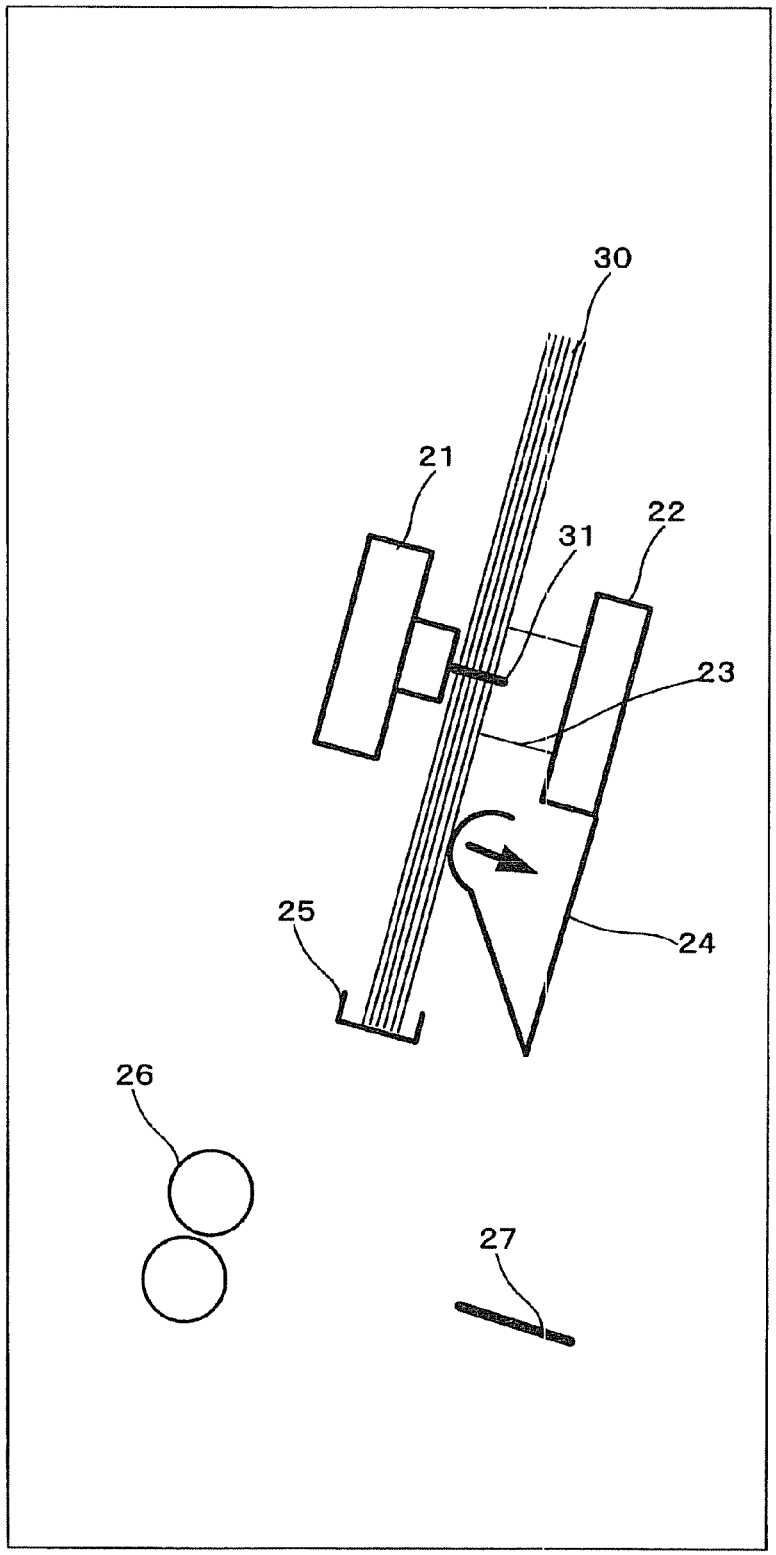
FIG. 5 is a diagram showing a state at the time of staple processing.

FIG. 5 is a diagram showing a state at the time of the staple processing. The stapler 21 moves to the anvil 22 side while striking a staple 31 into a sheet bundle 30. The staple 31 struck into the sheet bundle 30 is bent by the anvil 22. A spring force of the hooking control mechanism 24 for pushing the sheet bundle 30 to the stapler 21 side is weaker than a spring force of the stapler 21 for pushing the sheet bundle 30 to the anvil 22 side. Therefore, the hooking control mechanism 24 is pushed down in an arrow direction and the staple device can perform the staple processing.

Figure 6:
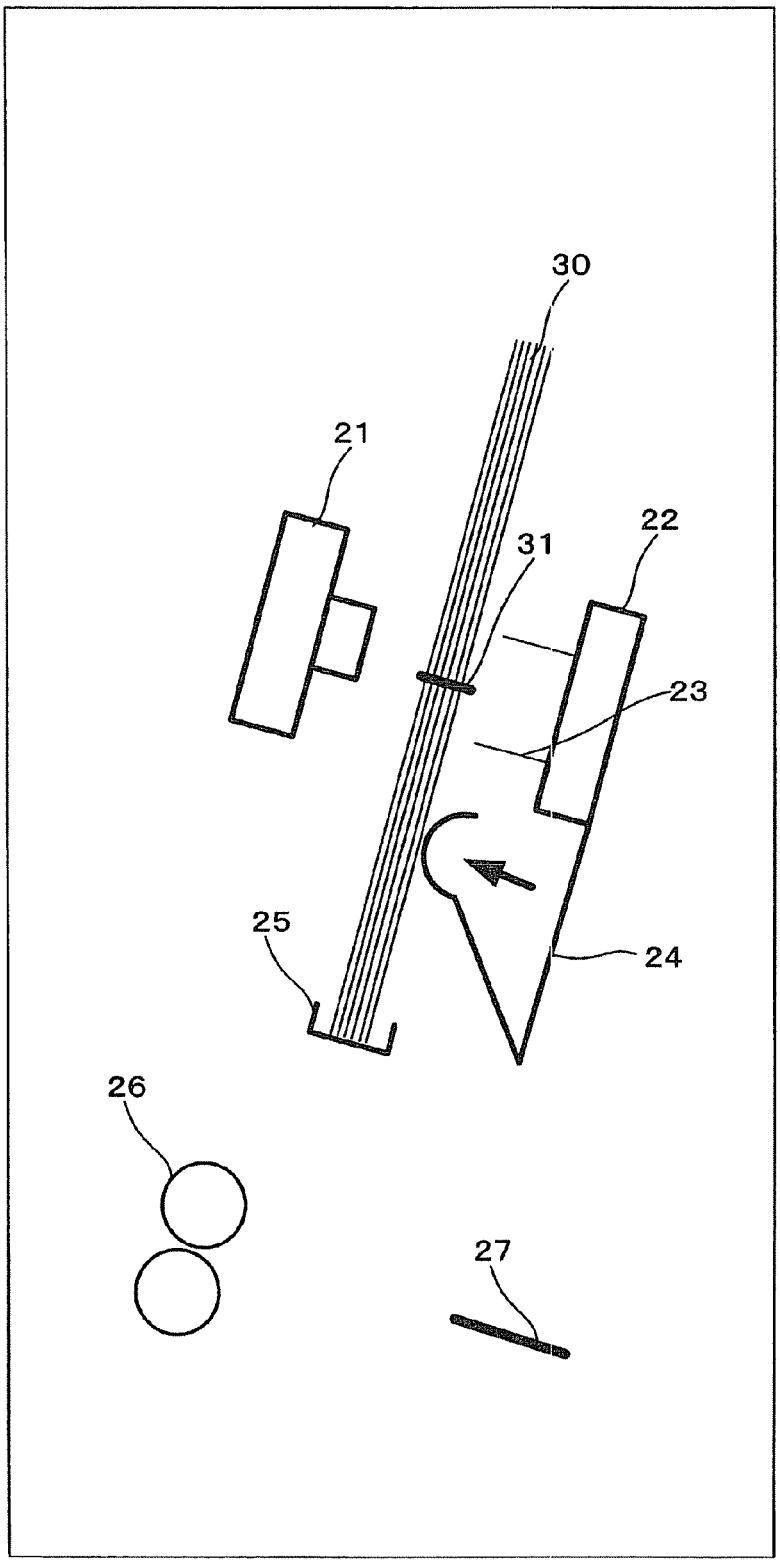
FIG. 6 is a diagram showing a state after the staple processing.

FIG. 6 is a diagram showing a state after the staple processing. The height in the stapler 21 direction of the hooking control mechanism 24 is larger than the height of the edge 23 of the anvil from the anvil 22 by at least the thickness of the staple 31 bent. Therefore, the stapler 21 returns to a home position. When the hooking control mechanism 24 pushes out the sheet bundle 30 in an arrow direction, the staple 31 is pushed out further to the stapler 21 side than the edge 23 of the anvil. A space is secured between the edge 23 of the anvil and the end.

Figure 7:
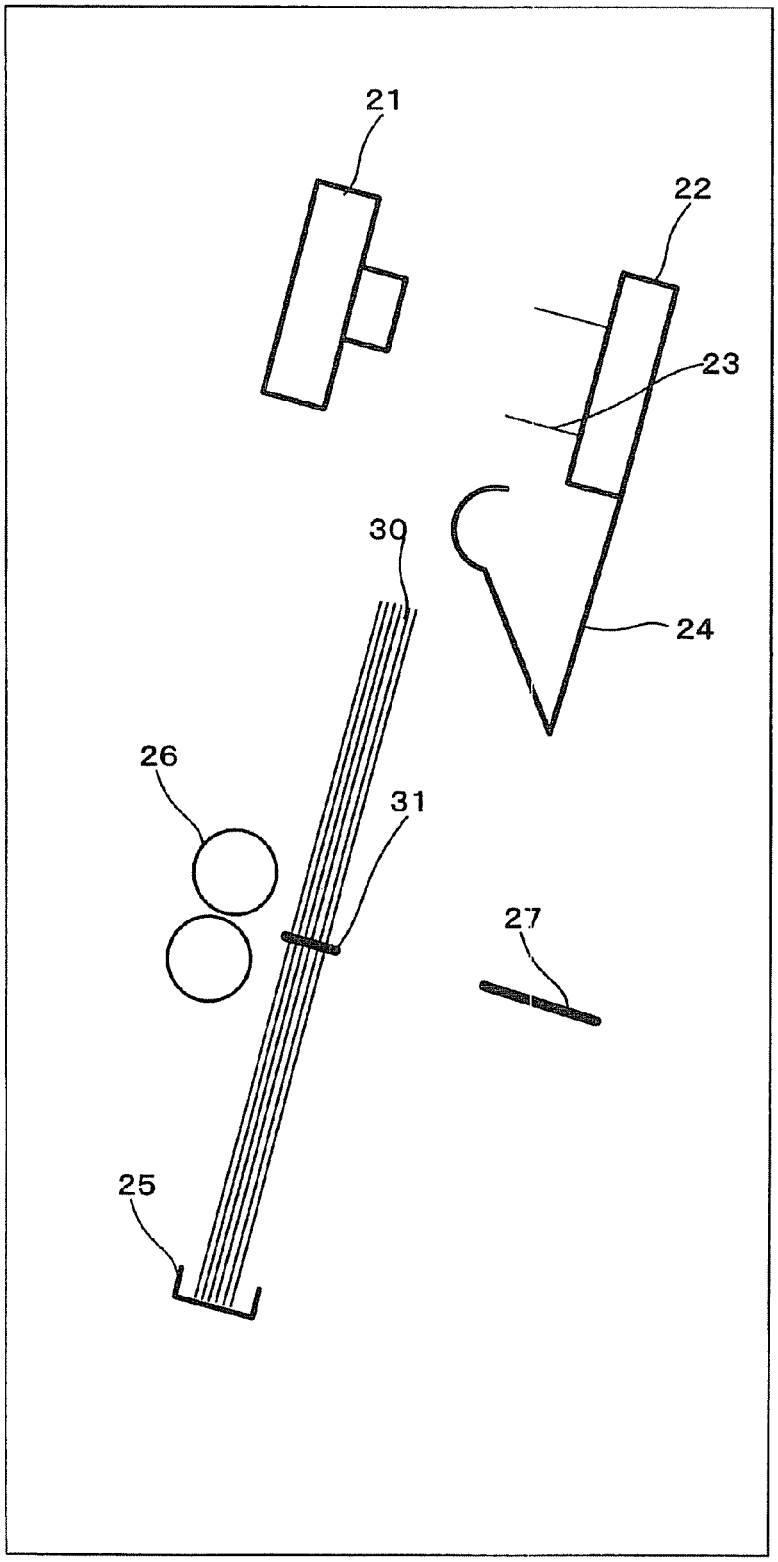
FIG. 7 is a diagram showing a state after conveyance of a sheet bundle.

FIG. 7 is a diagram showing a state after conveyance of a sheet bundle subjected to the staple processing. The hooking control mechanism 24 is provided in a position other than a path through which the staple 31 subjected to the staple processing passes when the sheet bundle 30 is conveyed to a center folding position. Therefore, the hooking control mechanism 24 does not hook on the staple 31.

The hooking control mechanism 24 is fixed to a member of the sheet post-processing apparatus 10, to which the anvil 22 is attached, by, for example, a screw or an adhesive. It is also possible to provide plural hooking control mechanisms 24 in the width direction of the sheets, i.e., a direction perpendicular to a sheet conveyance direction with the anvil 22 set between the hooking control mechanisms 24. The sheet bundle 30 is pushed in the center folding rollers 26 direction by the blade 27 and folded by the center folding rollers 26 to manufacture a booklet.

As described above, in the sheet post-processing apparatus 10 according to this embodiment, the hooking control mechanism 24 that pushes up the sheet bundle 30 in the direction of the stapler 21 to prevent the bent staple 31 from hooking on the edge 23 of the anvil is provided. This makes it possible to prevent the staple 31 from hooking on the edge 23 of the anvil when the sheet bundle 30 is conveyed after the staple processing.

The hooking control mechanism 24 pushes up the sheet bundle 30 to prevent the sheet bundle 30 from coming into contact with the edge 23 of the anvil. This makes it possible to prevent the sheets from being scratched by the edge 23 of the anvil.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet post-processing apparatus comprising:

a stapling device having a stapler that strikes a staple into a sheet bundle and an anvil that bends the struck staple;

center folding rollers that fold the sheet bundle subjected to staple processing in the center thereof; and a hooking control mechanism that is located on an opposite side of the center folding rollers across the sheet bundle, is formed on a spring having a curved surface in an end portion thereof coming into contact with the sheet bundle, is provided in a position other than a path through which the staple subjected to the staple processing passes when the sheet bundle is conveyed to a center folding position, and pushes the sheet bundle in a direction of the stapler to prevent the bent staple from hooking on an edge of the anvil.

2. A sheet post-processing apparatus according to claim 1, wherein a height of the hooking control mechanism in the direction of the stapler is higher than a height of the edge of the anvil from the anvil by at least a thickness of the bent staple.

3. A sheet post-processing apparatus according to claim 1, wherein a portion of the hooking control mechanism coming into contact with the sheet bundle is formed in a spherical shape.

4. A sheet post-processing apparatus according to claim 1, wherein the hooking control mechanism has a leaf spring or a compression spring.

5. A sheet post-processing apparatus according to claim 1, wherein a spring force of the hooking control mechanism for pushing the sheet bundle to the stapler side is weaker than a spring force of the stapler for pushing the sheet bundle to the anvil side.

6. A sheet post-processing apparatus according to claim 1, wherein plural hooking control mechanisms are provided in a width direction of sheets with the anvil set between the hooking control mechanisms.

7. A sheet post-processing apparatus comprising:

a stapling device having a stapler that strikes a staple into a sheet bundle and an anvil that bends the struck staple;

center folding rollers that fold the sheet bundle subjected to staple processing in the center thereof;

a sheet aligning member that aligns the sheet bundle and conveys the sheet bundle; and a hooking control mechanism that is located on an opposite side of the center folding rollers across the sheet bundle, is formed on a spring having a curved surface in an end portion thereof coming into contact with the sheet bundle, is provided in a position other than a path through which the staple subjected to the staple processing passes when the sheet bundle is conveyed to a center folding position, and pushes the sheet bundle in a direction of the stapler.

8. A sheet post-processing apparatus according to claim 7, wherein the hooking control mechanism is fixed to the sheet post-processing apparatus, to which the anvil is attached.

9. A sheet post-processing apparatus according to claim 7, wherein a height of the hooking control mechanism in the direction of the stapler is higher than a height of the edge of the anvil from the anvil by at least a thickness of the bent staple.

10. A sheet post-processing apparatus according to claim 7, wherein a portion of the hooking control mechanism coming into contact with the sheet bundle has a curved surface.

11. A sheet post-processing apparatus according to claim 7, wherein a portion of the hooking control mechanism coming into contact with the sheet bundle is formed in a spherical shape.

12. A sheet post-processing apparatus according to claim 7, wherein the hooking control mechanism has a leaf spring or a compression spring.

13. A sheet post-processing apparatus according to claim 7, wherein a spring force of the hooking control mechanism for pushing the sheet bundle to the stapler side is weaker than a spring force of the stapler for pushing the sheet bundle to the anvil side.

14. A sheet past-processing apparatus according to claim 7, wherein plural hooking control mechanisms are provided in a width direction of sheets with the anvil set between the hooking control mechanisms.

* * * * *